United States Patent [19]

Yamada et al.

[11] 4,130,044

[45] Dec. 19, 1978

[54] KEYBOARD MUSICAL INSTRUMENT AND IMPROVED PIANO

[75] Inventors: Takashi Yamada; Yasutoshi Kaneko; Kazuo Murakami, all of Hamamatsu, Japan

[73] Assignee: Nippon Gakki Seizo Kabushiki Kaisha, Japan

[21] Appl. No.: 722,398

[22] Filed: Sep. 13, 1976

[30] Foreign Application Priority Data

| | | | |
|---|---|---|---|
| Sep. 16, 1975 | [JP] | Japan | 50-125929[U] |
| Nov. 19, 1975 | [JP] | Japan | 50-156221[U] |
| Nov. 19, 1975 | [JP] | Japan | 50-156223[U] |

[51] Int. Cl.[2] ..... G10C 3/02

[52] U.S. Cl. ..... 84/176

[58] Field of Search ..... 84/174, 176, 177, 178–183

[56] References Cited

U.S. PATENT DOCUMENTS

| | | | |
|---|---|---|---|
| 2,494,700 | 1/1950 | Gage | 84/174 |

FOREIGN PATENT DOCUMENTS

| | | | |
|---|---|---|---|
| 338876 | 7/1921 | Fed. Rep. of Germany | 84/176 |
| 240055 | 9/1925 | United Kingdom | 84/176 |
| 464550 | 4/1937 | United Kingdom | 84/174 |

*Primary Examiner*—Lawrence R. Franklin

*Attorney, Agent, or Firm*—Ostrolenk, Faber, Gerb & Soffen

[57] ABSTRACT

A keyboard musical instrument such as a piano of relatively large size and heavy construction can be separated into two casings, each of which fully contains respective coacting elements of the instrument, for easy and free transportation, storage and access from outside.

21 Claims, 14 Drawing Figures

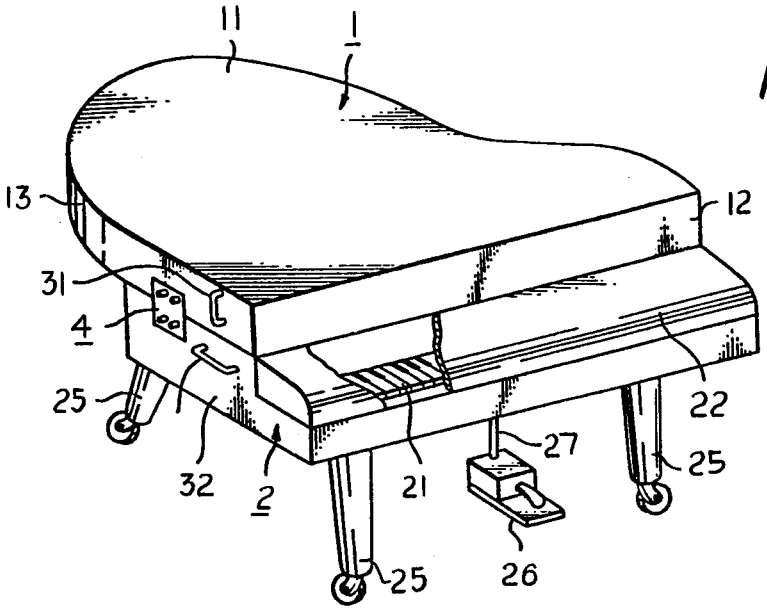
Fig. 1
Fig. 2
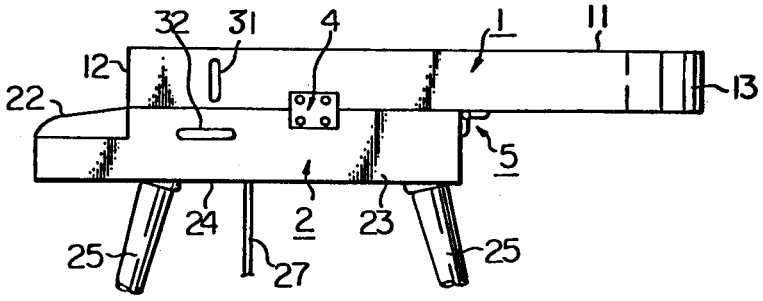
Fig. 3
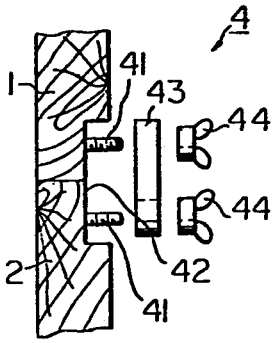
Fig. 4
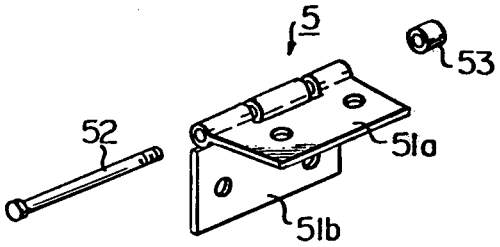

KEYBOARD MUSICAL INSTRUMENT AND IMPROVED PIANO

BACKGROUND OF THE INVENTION

The present invention relates to an improved keyboard musical instrument such as a piano, and more particularly relates to improvements in the construction of a keyboard musical instrument and a piano of relatively large size and heavy construction.

In the case of keyboard musical instruments such as grand pianos, a great deal of labour and time are needed to transport them and a large space is needed to store them. In addition, almost all of the elements of the musical instrument are confined within a casing and it is rather difficult to gain access to the elements within the casing.

For these reasons, keyboard musical instruments such as grand pianos are scarcely transported from one to the other place, being quite different from other types of musical instruments such as wind instruments and percussion instruments. Thus in the case of local concerts, professional pianists are forced to play on keyboard musical instruments usually provided at the site of the concert and with which they are quite unfamiliar.

OBJECTS OF THE INVENTION

The principal object of the present invention is to provide a keyboard musical instrument which can be transported very easily and simply.

Another object of the present invention is to provide a keyboard musical instrument which is suited for storage in spaces of limited size.

Yet another object of the present invention is to provide a keyboard musical instrument which enables players such as pianists to use the instrument, even at local concerts due to its high portable nature.

Still another object of the present invention is to provide a keyboard musical instrument which enables both users and tuners to have easy access to the interior of the instrument.

BRIEF DESCRIPTION OF THE INVENTION

In accordance with a basic aspect of the present invention, the keyboard musical instrument is comprised of two mutually separable casings, one of the casings fully encasing the strings, means for carrying the strings and damping means such as a damper assembly acting on the strings, and the other of the casings fully encasing keys and acting means such as an action assembly operationally coupled to said keys and related to said damping means. The two casings are left open in their mating area in the coupled state of the casings whereas the openings of the casings can preferably be closed when they are separated from each other for transportation and storage.

Although the following explanation will be focussed upon a grand piano as a typical example of the keyboard musical instrument in accordance with the present invention, the present invention is clearly applicable to other types of keyboard musical instruments with modifications obvious to persons skilled in the art.

BRIEF DESCRIPTION OF THE FIGURES

Further features and advantages of the present invention will be made clearer, reference being made to the embodiments shown in the accompanying drawings, in which;

FIG. 1 is a partly sectionalized perspective plan view of a grand piano embodying the present invention, parts unrelated to the invention being omitted for purposes of simplification, FIG. 2 is a side elevational view of the grand piano shown in FIG. 1, FIG. 3 is a partly sectional side plan view of the coupling assembly in a disassembled state usable for the grand piano shown in FIG. 1, FIG. 4 is a perspective view of the hinge assembly in a disassembled state used for the grand piano shown in FIG. 1.

DETAILED DESCRIPTION OF THE INVENTION

Figure 5:
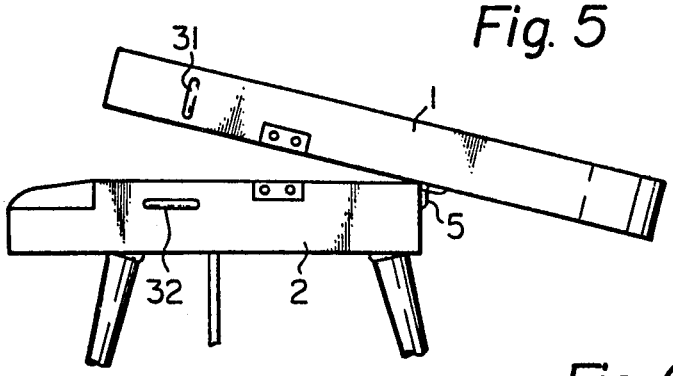
FIG. 5 is a side elevational view of the grand piano shown in FIG. 1, the upper casing being turned up from the lower casing.

As a typical example of the improved keyboard musical instrument in accordance with the present invention, a grand piano of an improved construction in accordance with the present invention is shown in FIGS. 1 and 2, in which the grand piano is comprised of an upper casing 1 adapted for accommodating the piano plate stretching strings and a lower casing 2 coupled along its top to the upper casing 1 and adapted for accomodating the action assembly of the piano as hereinafter described.

The upper cover 1 is provided, as in a conventional piano, with a top board 11, an upper beam 12 and a side board 13. However, the bottom portion of the upper casing 1 is left open in the area mating with the top of the lower casing 2.

The lower casing 2 is provided, as in conventional pianos, with keys 21 arranged side by side to each other, fall board 22 hinged at its rear upper side and adapted for covering the keys 21, a side board 23, a bottom board 24, legs 25 detachably disposed to the bottom board 24 and a pedal lyre assembly 26 operably related to the later described damper assembly in the upper casing 1 via a pedal rod 27. The top portion of the lower casing 2 is left open so that the interior thereof is in direct communication with that of the upper casing 1.

The upper casing 1 is provided with handles 31 arranged, on both sides thereof, and mounted on the side board 13. Similarly, the lower casing 2 is provided with handles arranged, at positions preferably close to the handles 31 on the upper casing 1, and mounted on the side board 23.

On both sides of the instrument, both side boards 13 and 23 are fixedly coupled to each other by coupling assembly 4 one of which is shown in detail in FIG. 3. The coupling assembly 4 includes a pair of threaded bolts 41 fixed to a shallow recess 42 formed at the border between the two casings 1 and 2, a seat plate 43 inserted over the bolts 41 and almost snugly received in the recess 42 and a pair of wing nuts 44 screwed over the bolts 41 in order to fasten the seat plate 43 in the recess 42, thereby firmly coupling the casings 1 and 2 together.

The casings 1 and 2 are further hingedly coupled to each other by a hinge assembly 5 arranged at the rear upper side of the lower casing 2 which is shown in detail in FIG. 4. The hinge assembly 5 includes a pair of hinge halves 51*a* and 51*b* connected to each other by a threaded bolt 52 and a fastening nut 53. One of the hinge halves, say the half 51*a* is fixed to the bottom board of the upper casing 1 whereas the other half 51*b* to the side board back of the lower casing 2.

Figure 6:
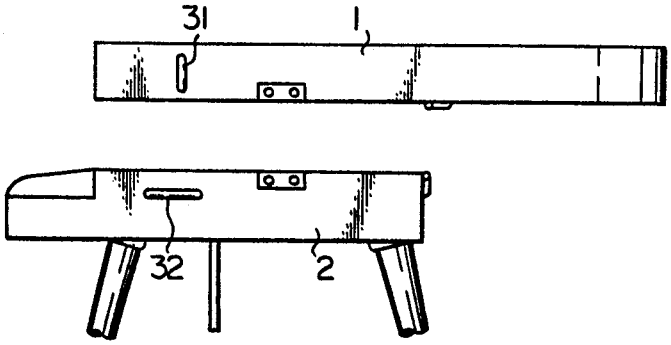
FIG. 6 is a side elevational view of the grand piano shown in FIG. 1, both casings being separated from each other.

Thus, when only the coupling assembly 4 is disassembled, the upper casing 1 can be swung upwardly and away from the lower casing 2 about the hinge axis of the hinge assembly 5 as shown in FIG. 5. When the hinge assembly 5 is also disassembled, the upper casing 1 can be fully separated from the lower casing 2 as shown in FIG. 6.

Figure 7:
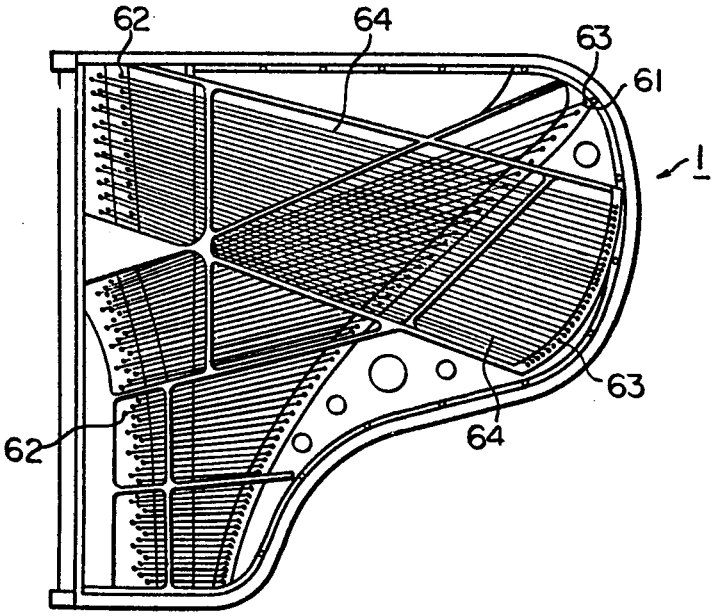
FIG. 7 is a top plan view of the piano plate usable for the grand piano shown in FIG. 1.

As shown in FIG. 7, the plate 61 is arranged in upper casing 1. A number of tuning pins 62 arranged on the keyboard side of the plate 61 and a corresponding number of hitch pins 63 arranged on the other side of the plate 61, and strings 64 are stretched between both groups of pins 62 and 63. The piano plate 61 is fixedly supported in the upper casing 1 similar to the arrangement found in conventional pianos. Further, the above-described damper assembly is arranged in the upper casing 1, which will be explained in detail in relation to the latter described action assembly.

Figure 8:
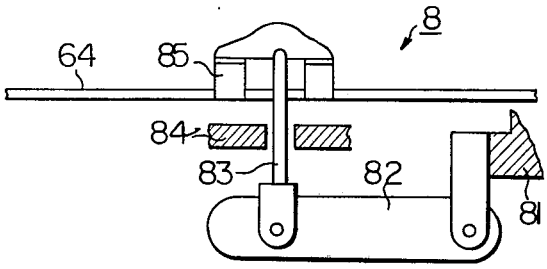
FIG. 8 is a side elevational view, partly in section, of the key, the action assembly and the damper assembly usable for the grand piano shown in FIG. 1.
Figure 8:
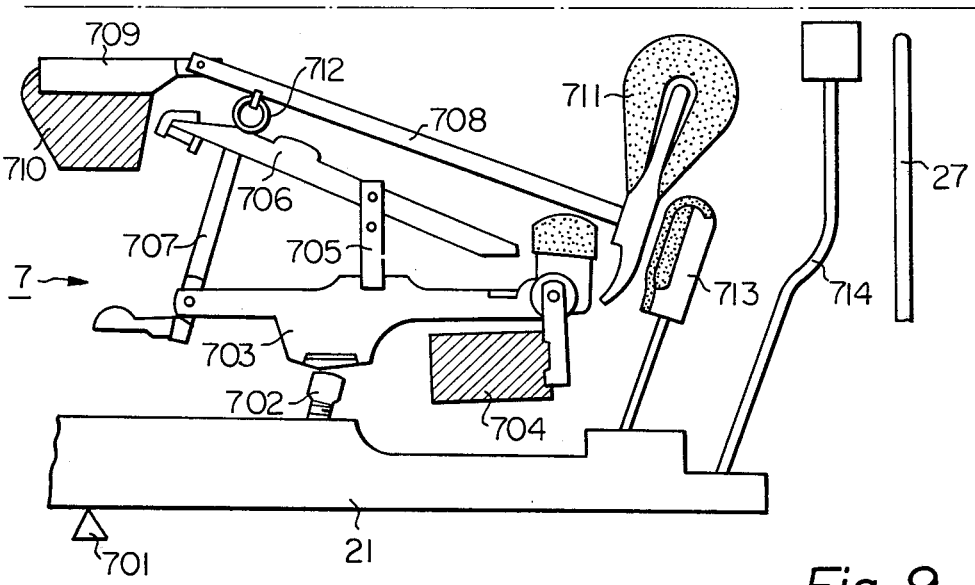

Referring to FIG. 8, the construction of each action assembly 7 and each damper assembly 8 are shown in detail. In the illustration, the passable border between the both casings 1 and 2 is shown with a chain and dot line.

The key 21 is pivoted at a support 701 provided on any suitable stationary part of the lower casing 2 and, at a position somewhat rearwardly of the support 701, an upwardly projecting capstan screw 702 is fixed to the top surface of the key 21.

On the upper side of the key 21 is provided a wippen 703 which is pivoted at the rear end to a stationary rail 704. This wippen 703 is supported on the bottom thereof by the capstan screw 702 on the key 21. An upright support 705 is fixed to about the midway top surface of the wippen 703 and, at the top end thereof, swingably carries a repetition lever 706. A jack 707 is pivotally joined to the free front end, of the wippen 703 and the top end of the jack 707 is slidably received in a vertical slot (not shown) formed in the front end portion of the repetition lever 706. On the upper side of the repetition lever 706 is provided a hammer shank 708 pivoted at the front end thereof to a hammer shank flange 709 fixed to a stationary hammer rest rail 710. The hammer shank 708 carries a hammer top felt 711 at the rear end thereof. At a position on the hammer shank 708 close to the pivoted end is arranged a roller 712 which is in contact with the front top surface of the repetition lever 706. At a position close to the hammer top felt 711, a back check 713 is fixed to the top surface of the key 21. An upwardly extending sostenute lift rod 714 is attached to the rear end top surface of the key 21 and the top end portion of the pedal rod 27 is located close to and to the rear side of the sostenute lift rod 714.

As is clear from the drawing, the above-described elements of the action assembly 7 are all arranged within the lower casing 2, in which the keys 21 are also provided, and the mode of their combined arrangement is substantially common to that of the conventional pianos. In the above-described construction, means for urging operating elements are omitted for purposes of simplification.

The damper assembly 8 includes a stationary damper lever rail 81 which pivotally supports the rear end of a damper lever 82 in an arrangement such that the middle of the lever stem is positioned approximately over the top end of the pedal rod 27 and the front end thereof comes close to and just over the top end of the sostenute lift rod 714. The front end of the damper lever 82 pivotally carries a damper wire 83 which extends upwardly through a stationary guide rail 84 and carries atop damper felts 85. The damper felts 85 are normally placed in contact with the associated string 64 via suitable urging means (not shown) operable on the damper lever 82. As already described the above-described elements of the damper assembly 8 are all arranged within the upper casing 1 in which the piano plate 61 is also arranged.

Figure 9:
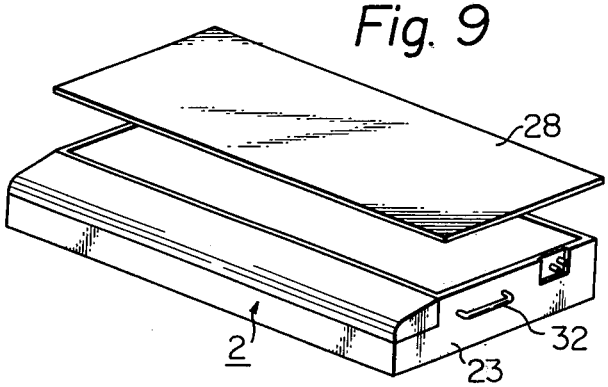
FIG. 9 is a perspective view of a modification of the grand piano shown in FIG. 1.
Figure 10:
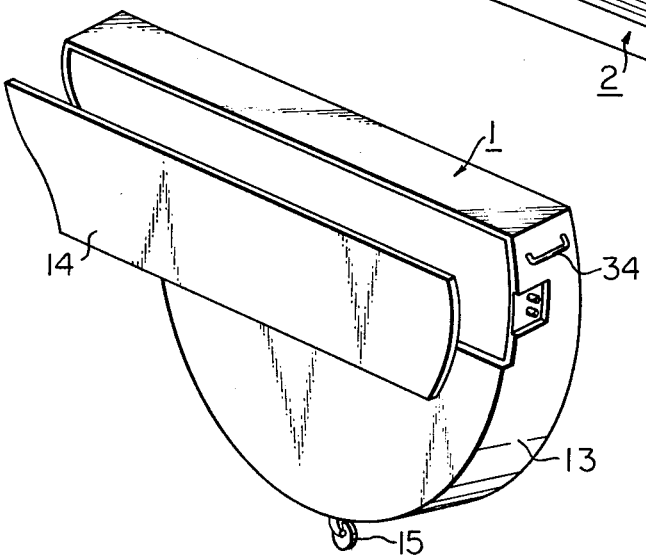
FIG. 10 is a perspective view of a further modidication of the grand piano shown in FIG. 1.

When the two casings 1 and 2 are separated from each other as shown in FIG. 6, a part of the bottom of the upper casing 1 and the top of the lower casing 2 are both left open due to absence of any border board between the two. So, in order to prevent the elements contained within the casings 1 and 2 from any possible damage which may be caused during transportation and/or storage of them, cover boards 14 and 28 may preferably be used for closing the openings as shown in FIGS. 9 and 10. In a further preferred embodiment of the present invention, a wheel 15 may be attached to the side board back of the lower casing 2 for easy transportation of same. The cover boards 14 and 28 are detachably fixed to their associated casings 1 and 2 in a suitable known manner.

Figure 11:
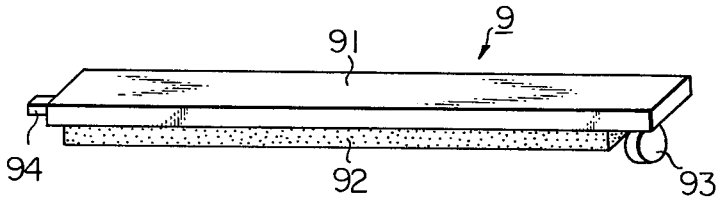
FIG. 11 is a perspective view of a pressor bar assembly usable for the grand piano shown in FIG. 1.
Figure 12:
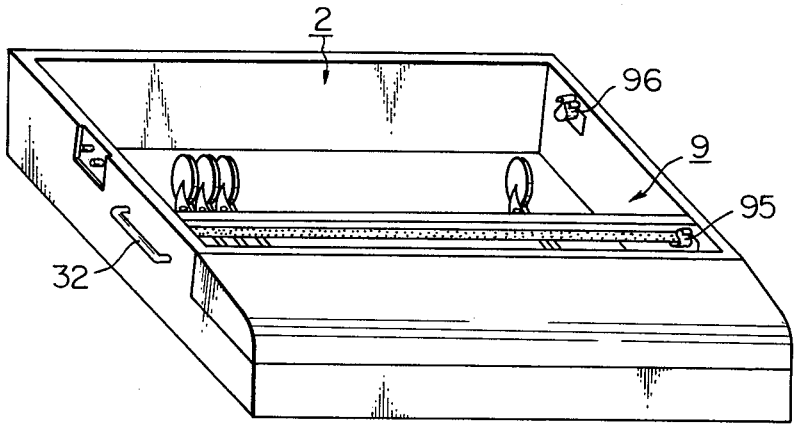
FIG. 12 is a perspective view for showing setting of the pressor bar assembly in the lower casing of the grand piano.
Figure 13:
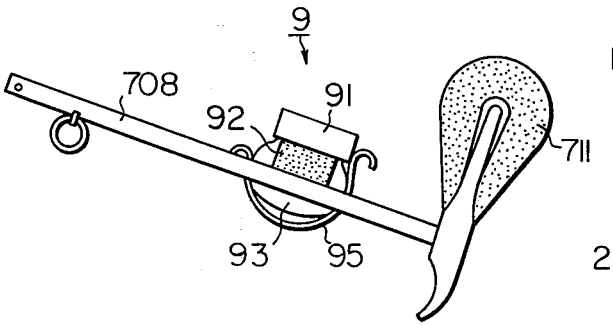
FIG. 13 is a side elevational view for showing setting of the pressor bar assembly.

As already described, the action assemblies 7 each including the hammer shank 708 are contained in the lower casing 2 and, during transportation of the latter, the hammer shanks 708 tend to swing about their pivotal supports on the associated hammer rest rails 710, such unnecessary swing causing accidental breakages of the hammer shanks 708 and their related parts. So, if possible, it is preferable to provide means for restraining such unfavourable swing of the hammer shanks 708 during transportation of the lower casing 2. One example of such swing restraining means is shown in FIGS. 11 through 13, in which is provided a pressor bar 91 of a length covering at least the total width of the hammer shanks 708 and the spaces between neighbouring hammer shanks. The bottom of pressor bar 91 is provided, with a cushion layer 92 made of a shock absorbing material such as felt. The pressor bar 91 is further provided, on one end thereof, with one engaging member 93 projecting downwardly and, on the other end thereof, another engaging member 94 projecting sideways as shown in FIG. 11.

In accordance with this, the lower casing 2 is provided, on one inner wall surface of the side board 23, with two engaging clamps 95 and 96 and, on the other inner wall surface of the side board 23, with two engaging recesses (not shown). The engaging clamps and the engaging recesses are arranged on the inner wall surfaces of the side board 23 so that one of the engaging clamps on one inner wall surface is in axial alignment with one of the engaging recesses on the other inner wall surface.

The pressor bar assembly 9 is set in position in the lower casing 2 so that the second engaging member 94 is inserted into one of the recesses in the inner wall surface whereas the first engaging member 93 is pressed into one of the engaging clamps forming an axially aligned pair with the above-described engaging recess.

Positions of the pairs, each being formed by the clamp and the recess, should be so chosen that, when the pressor bar assembly 9 is in engagement with the front side pair, the cushion layer 92 of the pressor bar assembly 9 is brought into pressure contact with the hammer shanks 708 of the action assembly 7 as shown in FIGS. 12 and 13, thereby restraining free swing of the hammer shanks 708 during transportation and storage. The position of the other pair, i.e. the rear pair, should be so chosen that, when the pressor bar assembly 9 is in engagement with the rear side pair, presence of the pressor bar assembly 9 should never hinder motions of any other operational elements of the piano.

As already described, casings 1 and 2 are coupled to each other via the coupling assembly 4 and the hinge assembly 5 only. So, it is rather difficult in practice to couple them together always in the strictly correct relative position to each other. As the damper assembly 8 arranged in the upper casing 1 is operationally related to the action assembly 7 arranged in the lower casing 2, a slight discrepancy in the relative position between the two casings 1 and 2 may have a delicate influence upon the acoustic characteristics of the piano to which the present invention is applied. From this point of view, it is preferable to provide means for establishing the correct relative position between the two casings 1 and 2 in the coupled state.

Figure 14:
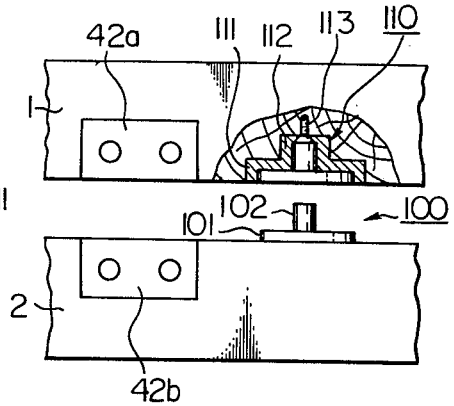
FIG. 14 is a partly cut off side view for showing the correct relative position establishing means.

One example of such correct relative position establishing means is shown in FIG. 14, in which one position fixing piece 100 is made up of a flange 101 and a post 102 projecting upwardly from the flange 101. The flange 101 is fixed to the fringe surface of the side board of one of the casings at a proper position. In the illustrated embodiment, the position fixing piece 100 is fixed to the top surface of the side board 23 of the lower casing 2 at a position near the recess half **42*b*. The other position fixing piece 110 is made up of a large diameter cylinder 111 and a small diameter cylinder 112. The dimensions of two cylinders are chosen so that the first position fixing piece 100 can be snugly received within the second position fixing piece 110. The second position fixing piece 110 is almost fully embedded in the fringe surface of the side board of the other of the casing and fixed therein by a set screw 113 at a position corresponding to the position of the first fixing piece 100 on the one casing. In the case of the illustrated embodiment, the second position fixing piece 110 is embedded in the bottom surface of the side board 13 of the upper casing 1 at a position near the recess half 42*a* and corresponding to that of the first fixing piece 100**.

When the two casings 1 and 2 are to be coupled together, the first fixing piece 100 is snugly received within the second fixing piece 110 and the relative position between the both casings 1 and can be quite correctly aligned without any further adjustment for that purpose.

It should be well understood that application of the present invention is not limited to the embodiments shown in the illustrated drawings and various modifications can be derived from the basic aspect of the present invention.

For example, as a substitute for the construction of the coupling assembly 4 shown in FIG. 3, one of the threaded bolts 41 may be omitted and, on the omitted side, the seat plate 43 may be advancedly fixed to one of the casings by any suitable known manner. One of the wing nuts 44 may be omitted in this case, too.

The hinge assembly 5 may be omitted also when it is unnecessary to lift the upper casing 1 as shown in FIG. 5.

On the contrary, when the hinge assembly 5 is used for enabling the lifting of the upper casing 1, it is preferable to provide any supporting element for holding the upper casing 1 in the turned-up state shown in FIG. 5.

Further, in the embodiment shown in FIG. 12, the rear side pair made up of the engaging clamp 96 and the corresponding engaging recess may be omitted.

The fixing pieces 100 and 110 shown in FIG. 14 may be modified in their shapes so far as one of the pieces can be snugly received in the other of the pieces.

Further, application of the present invention is not limited to grand pianos but can be used with various types of keyboard musical instruments in which a number of keys are arranged side by side so that they can be operated by a player's fingers quite independently from each other, a corresponding number of strings are stretched in spaced side by side relationship to each other on a frame, an assembly for acting on an associated one of the strings for acoustic vibration of the latter is operationally coupled to a corresponding one of the keys and an assembly for damping the acoustic vibration of the string is operationally related to the acting assembly.

Through employment of the present invention in the construction of the above-described keyboard musical instruments, the following advantages can be resulted.

(a) As the casing containing acoustic elements can be separated into two parts of relatively compact construction, transportation of pianos can be very greatly facilitated and simplified.

(b) As the casing can be separated into two parts each of smaller construction and simpler outer shapes, musical instruments can be stored at any place of compact space.

(c) Even in the case of musical instruments of a large size and heavy construction such as grand pianos, simplification in the transportation in the separated state enables players to carry and use their own musical instruments at any place for concert. This is very important for professional pianists, or even for highly expert amateur pianists as they are in general very keen in their personal preference for musical instruments they use.

(d) As the casing can be separated into two parts and the mating portion of the parts may be left open in the separated state, users or tuners of the musical instruments can have an easy observation and access to the interior of the musical instruments.

(e) As the acoustic elements are fully confined within the respective parts of the casing in such a fashion that elements arranged in one of the parts never extend into the other of the parts, accidental damage to the elements in the respective parts during transportation and storage can be fully avoided with use of the cover boards 14 and 28.

(f) Use of the wheel 15 in the embodiment shown in FIG. 10 further eases and simplifies transportation of the musical instrument.

(g) Use of the presser bar assembly 9 in the embodiment shown in FIGS. 11 through 13 restrains unfavourable swing of the hammer shanks 708 during transportation, thereby mitigating accidental breakage of the hammer shanks and their related parts.

(h) Use of the position fixing pieces in the embodiment shown in FIG. 14 results in very simplified and straightforward establishment of the correct relative position between the separated two parts of the casing when they are to be coupled to each other. Thus, even frequent separation and coupling of the two casing parts has no substantial ill influence upon the acoustic characteristics of the musical instruments to which the present invention is applied.

What is claimed is:

1. A horizontal grand-type piano, comprising:

(A) a keyboard comprising a plurality of individually actuatable keys;

(B) an action assembly comprising:

(1) a plurality of hammers, a different said hammer associated with each of said keys;

(2) linkage means for impelling each said hammer from a first, rest position towards a second, operative position in response the actuation of its corresponding said key;

(C) a first, elongated housing member at least partially housing said keyboard and said action assembly, said first housing member having an opening in the upper surface thereof, each of said hammers being so oriented within said first housing member that each said hammer lies below said opening and within said first housing member when it is in its first, rest position and lies above said opening and without said first housing member when it is in said second, operative position, said first housing member having an upwardly facing, elongated support surface lying in a horizontal plane;

(D) vertical leg means for supporting said first housing member above a horizontal support plane such that said first housing member is elongated in a generally horizontal plane;

(E) a plurality of piano strings carried by a piano plate;

(F) a second, elongated housing member at least partially housing said piano plate and said strings, an opening formed in the bottom of said second housing member and providing direct access to each of said strings, said second housing member having a downwardly facing elongated support surface lying in a horizontal plane; and (G) means for releasably connecting said second housing member to said first housing member in such a manner that said downwardly facing support surface of said second housing member lies on top of said upwardly facing support surface of said first housing member in such a manner that the weight of said second housing member is supported by said upwardly facing support surface of said first housing member and a strong frictional force is established between said upwardly and said downwardly facing support surfaces;

(H) said strings being so located within said second housing member that they lie in a generally horizontal plane when said second housing member is coupled to said first housing member;

(I) said second housing member lying in a generally horizontal plane on top of and offset with respect to said first housing member;

(J) said opening in said first housing member communicating with said opening in said second housing member; and (K) the relative location of said hammers and said strings being such that each of said hammers strikes a different set of said strings when its respective key is actuated.

2. A piano as claimed in claim 1, further comprising handles coupled to the outer surfaces of said first and second housing members to facilitate lifting and carrying of said housing members.

3. A piano as claimed in claim 1, further comprising at least one rotatably mounted wheel coupled to the outer surface of at least one of said two housing members.

4. A piano as claimed in claim 1, further comprising hinge means for hingedly connecting said first and second housing members in such a manner that said second housing member can be rotated out of said horizontal plane when said releasably connecting means releases said first and second housing members, whereby access to said strings and said hammers is provided via said opening in said second and first housing members, respectively.

5. A piano as claimed in claim 1, further comprising cover means for closing said opening in each of said housing members when said housing members are not connected.

6. A piano as claimed in claim 5 wherein said cover means includes first and second cover boards adapted to be coupled to said opening in said first and second casing, respectively.

7. A piano as claimed in claim 1, further comprising means for restraining free movement of said hammers during transportation of said first housing member.

8. A piano as claimed in claim 7, wherein said restraining means includes a presser bar assembly having a cushion layer and means for holding said presser bar within said first housing member in such an arrangement as to place said cushion layer in pressure contact with said hammers.

9. A piano as claimed in claim 8, wherein further means for releasably holding said presser bar at a position outside the moving ambit of said hammers is provided within said first housing member.

10. A piano as claimed in claim 1, wherein said releasably connecting means includes means for establishing the correct relative position between said first and second housing members when said coupling means couples said first and second housing members to each other.

11. A piano as claimed in claim 10, wherein said correct relative position establishing means include a first fixing piece coupled to said first housing member and a second fixing piece coupled to said second housing member at a position corresponding to that of said first fixing piece, one of said fixing pieces being of a shape and dimension snugly receivable in the other of said fixing pieces.

12. A piano as claimed in claim 1, further including damping means at least partially housed in said second housing member, said damping means for selectively damping the vibration of said strings.

13. A horizontal grand type piano, comprising:

(A) a keyboard comprising a plurality of individually actuatable keys;

(B) an action assembly comprising:

(1) a plurality of hammers, a different said hammer associated with each of said keys; and (2) linkage means for impelling each said hammer from a first, rest position towards a second, operative position in response to the actuation of its corresponding said key;

(C) a first housing member supporting said keyboard and said action assembly, said first housing member having an opening formed therein;

(D) a plurality of piano strings carried by a piano plate;

(E) a second housing supporting said piano strings, said second housing member having an opening formed therein, said opening in said second housing member providing direct access to said strings;

(F) vertical leg means for supporting said first and second housing members above a horizontal support plane;

(G) said first housing member having an upwardly facing, elongated support surface lying in a horizontal plane, said hammers being so located within said first housing member that they are positioned below a predetermined horizontal plane when in said first, rest position and are positioned above said predetermined horizontal plane when in said second, operative position;

(H) said second housing member having a downwardly facing elongated support surface lying in a horizontal plane; and (I) means for releasably connecting said second housing member to said first housing member in such a manner that:

(1) said downwardly facing support surface of said second housing member lies on top of said upwardly facing support surface of said first housing member in such a manner that the weight of said second housing member is substantially supported by said upwardly facing support surface of said first housing member and a strong frictional force is established between said upwardly and downwardly facing support surfaces;

(2) said strings lie in a plane substantially parallel to and spaced from said predetermined horizontal plane;

(3) said opening in said first housing member communicates with said opening in said second housing member; and (4) the relative location of said hammers and said strings is such that each of said hammers strikes a different set of said strings when its respective key is actuated.

14. A piano as claimed in claim 13, further comprising first and second handles coupled to the outer surfaces of said first and second housing members, respectively.

15. A piano as claimed in claim 13, further comprising at least one rotary wheel coupled to the outer surface of at least one of said two housing members.

16. A piano as claimed in claim 13, further comprising hinge means for swingably coupling said first and second housing members in such a manner that said second housing member can be rotated with respect to said first housing member when said releasably connecting means releases said first and second housing members whereby access to said hammers and said strings is provided via said opening in said first and second housing members, respectively.

17. A piano as claimed in claim 13, further comprising means for closing said openings in said first and second housing members when said housing members are not connected.

18. A piano as claimed in claim 13, further comprising means for selectively restraining free movement of said hammers.

19. A piano as claimed in claim 13, wherein said releasably connecting means includes means for establishing the correct relative position between said first and second housing members when said releasably connecting means connects said first and second housing members to each other.

20. A piano as claimed in claim 13, wherein said second housing member is an upper housing and said first housing member is a lower housing.

21. A piano as claimed in claim 13, further including damping means housed in said second housing for selectively damping the vibration of said strings.

* * * * *